US009872095B2

(12) United States Patent
Lee

(10) Patent No.: US 9,872,095 B2
(45) Date of Patent: Jan. 16, 2018

(54) SOUND BOX AND AUDIO PLAYING DEVICE

(71) Applicant: ATAKE DIGITAL TECHNOLOGY (SHENZHEN) CO., LTD., Shenzhen, Guangdong Province (CN)

(72) Inventor: Kuo Tsai Lee, Shenzhen (CN)

(73) Assignee: ATAKE DIGITAL TECHNOLOGY (SHENZHEN) CO., LTD., Shenzhen, Guangdong Province (CN)

( * ) Notice: Subject to any disclaimer, the term of this patent is extended or adjusted under 35 U.S.C. 154(b) by 324 days.

(21) Appl. No.: 14/375,432

(22) PCT Filed: Jul. 9, 2013

(86) PCT No.: PCT/CN2013/079025
§ 371 (c)(1),
(2) Date: Jul. 29, 2014

(87) PCT Pub. No.: WO2014/201738
PCT Pub. Date: Dec. 24, 2014

(65) Prior Publication Data

US 2015/0365748 A1 Dec. 17, 2015

(30) Foreign Application Priority Data

Jun. 17, 2013 (CN) ..... 2013 2 0346439 U

(51) Int. Cl.
*H04R 1/02* (2006.01)
*B05B 17/08* (2006.01)

(52) U.S. Cl.
CPC ..... *H04R 1/028* (2013.01); *B05B 17/08* (2013.01); *H04R 1/025* (2013.01)

(58) Field of Classification Search
CPC ..... H04R 1/028; H04R 1/025; B05B 17/08
See application file for complete search history.

(56) References Cited

U.S. PATENT DOCUMENTS 6,505,782 B1 * 1/2003 Yen ..... B05B 17/08 239/17
7,617,624 B1 * 11/2009 Chen ..... G09F 19/02 40/406
2002/0118531 A1 * 8/2002 Yang ..... A63J 17/00 362/96

FOREIGN PATENT DOCUMENTS

CN 202019428 U 10/2011
CN 202172484 * 3/2012 ..... H04R 1/44
(Continued)

*Primary Examiner* — Fan Tsang
*Assistant Examiner* — Angelica M McKinney
(74) *Attorney, Agent, or Firm* — Cheng-Ju Chiang

(57) ABSTRACT

The present disclosure discloses a sound box and an audio playing device comprising the sound box. The sound box comprises a housing and a transparent cover fixedly connected with the housing. The sound box further comprises a transparent base fixedly connected with the transparent cover, a water spraying plate provided with a spray nozzle, and a fan blade for draining off water. A first water tank, a second water tank and a receiving tank for receiving the fan blade are provided on the transparent base. The receiving tank communicates with the first water tank and the second water tank respectively and a liquid in the first water tank is drained off by the fan blade to the second water tank. The water spraying plate is adapted to the second water tank and the fan blade is provided with first magnets. The housing has a motor and a fixing plate disposed therein. A rotary shaft of the motor are fixedly connected with the fixing plate and the fixing plate is provided with second magnets to cooperate with the first magnets. The present disclosure can extend the lifetime of the motor.

15 Claims, 3 Drawing Sheets

(56) References Cited

FOREIGN PATENT DOCUMENTS

| | | | | |
|---|---|---|---|---|
| CN | 202172484 | U | | 3/2012 |
| CN | 202238485 | U | | 5/2012 |
| CN | 103111395 | A | | 5/2013 |
| CN | 202998448 | U | | 6/2013 |
| CN | 203155456 | U | | 8/2013 |
| CN | 203243485 | U | | 10/2013 |
| CN | 202238485 | | * | 5/2015 |

* cited by examiner

SOUND BOX AND AUDIO PLAYING DEVICE

CROSS REFERENCE TO RELATED APPLICATIONS

The present application is a 35 U.S.C. §371 National Phase conversion of International (PCT) Patent Application No. PCT/CN2013/079025, filed on Jul 9, 2013, the disclosure of which is incorporated by reference herein. The PCT International Patent Application was filed in Chinese.

FIELD OF THE INVENTION

The present disclosure relates to the technical field of electronic products, and more particularly, to a sound box and an audio playing device.

BACKGROUND OF THE INVENTION

The fountain sound box produces rhythmic dancing water columns in response to music rhythms produced by the sound box itself or directly following the rhythms of the background sound. Therefore, through the combination of the dancing water columns and the lighting effect, a great visual effect is provided. In the existing technique, the fountain sound box comprises a fan blade for controlling the water spraying and a motor fixedly connected with the fan blade to control the rotation of the fan blade. Since the motor needs to be placed in water, the motor might be damaged due to water penetration during the long period of service, and this makes the service life of the motor relatively short.

SUMMARY OF THE INVENTION

A primary objective of the present disclosure is to provide a sound box in which the service life of a motor in the sound box can be extended.

To achieve the aforesaid objective, the present disclosure provides a sound box comprising a housing and a transparent cover fixedly connected with the housing. The sound box further comprises a transparent base fixedly connected with the transparent cover, a water spraying plate provided with a spray nozzle, and a fan blade for draining off water. A first water tank, a second water tank and a receiving tank for receiving the fan blade are provided on the transparent base. The receiving tank communicates with the first water tank and the second water tank respectively and a liquid in the first water tank is drained off by the fan blade to the second water tank. The water spraying plate is adapted to the second water tank and the fan blade is provided with first magnets. The housing has a motor, a fixing plate and a loudspeaker disposed therein. The loudspeaker and a rotary shaft of the motor are fixedly connected with the fixing plate respectively, and the fixing plate is provided with second magnets to cooperate with the first magnets. The transparent cover is further formed with a sound transmission channel extending through a top portion and a bottom portion thereof; and a sound guiding element for guiding the sound from the loudspeaker to the sound transmission channel is disposed in the housing and fixedly connected with the transparent base.

Preferably, the receiving tank is located at a lowest water storage position of the first water tank and is formed to be recessed from the lowest water storage position.

Preferably, the first magnets and the second magnets are disposed to face towards each other.

Preferably, the sound box further comprises a printed circuit board (PCB) located in the housing and fixedly connected with the housing. The PCB is electrically connected with the loudspeaker and the motor respectively to output an external sound source signal to the loudspeaker and, according to an audio level of the external sound source signal, output a control signal to the motor to control the rotation speed of the motor.

Preferably, the sound box further comprises a lamp holder installed with an LED lamp and a light shielding plate for shielding light. The lamp holder is fixedly connected with the transparent base and cooperates with the transparent base to clamp the sound guiding element. The LED lamp is disposed to face towards the spray nozzle, and the light shielding plate is formed with a through-hole that is adapted to the spray nozzle.

Preferably, the sound box further comprises a button controlling unit for controlling an operation state of the sound box. The button controlling unit comprises a touch element, a silicone button, a touch pressing plate, a button circuit board electrically connected with the PCB, a flexible circuit board electrically connected with the PCB and a light guiding element for displaying a sound volume. One end of the touch element is disposed to protrude from the housing, and the other end of the touch element faces towards the silicone button, the button circuit board and the flexible circuit board. The touch pressing plate comprises receiving cavities for receiving the silicone button, the button circuit board and the flexible circuit board. The touch pressing plate is fixedly connected with the housing and clamps the touch element. The light guiding element comprises a plurality of light sources distributed uniformly along a same circumference, and all of the light sources are connected with the PCB.

Preferably, the sound box further comprises a partition for preventing formation of an eddy at the center of the fan blade. The partition is located at one side of the fan blade that faces away from the housing, and is fixedly connected with the transparent base.

The present disclosure further provides an audio playing device comprising a sound box. The sound box comprises a housing and a transparent cover fixedly connected with the housing. The sound box further comprises a transparent base fixedly connected with the transparent cover, a water spraying plate provided with a spray nozzle and a fan blade for draining off water. A first water tank, a second water tank and a receiving tank for receiving the fan blade are provided on the transparent base. The receiving tank communicates with the first water tank and the second water tank respectively and a liquid in the first water tank is drained off by the fan blade to the second water tank. The water spraying plate is adapted to the second water tank and the fan blade is provided with first magnets. The housing has a motor, a fixing plate and a loudspeaker disposed therein. The loudspeaker and a rotary shaft of the motor are fixedly connected with the fixing plate respectively. The fixing plate is provided with second magnets to cooperate with the first magnets, and the transparent cover is further formed with a sound transmission channel extending through a top portion and a bottom portion thereof. A sound guiding element for guiding the sound from the loudspeaker to the sound transmission channel is disposed in the housing and fixedly connected with the transparent base.

Preferably, the receiving tank is located at a lowest water storage position of the first water tank and is formed to be recessed from the lowest water storage position.

Preferably, the first magnets and the second magnets are disposed to face towards each other.

Preferably, the sound box further comprises a PCB located in the housing and fixedly connected with the housing. The PCB is electrically connected with the loudspeaker and the motor respectively to output an external sound source signal to the loudspeaker and, according to an audio level of the external sound source signal, output a control signal to the motor to control the rotation speed of the motor.

Preferably, the sound box further comprises a lamp holder installed with an LED lamp and a light shielding plate for shielding light. The lamp holder is fixedly connected with the transparent base and cooperates with the transparent base to clamp a sound guiding element. The LED lamp is disposed to face towards the spray nozzle, and the light shielding plate is formed with a through-hole that is adapted to the spray nozzle.

Preferably, the sound box further comprises a button controlling unit for controlling an operation state of the sound box. The button controlling unit comprises a touch element, a silicone button, a touch pressing plate, a button circuit board electrically connected with the PCB, a flexible circuit board electrically connected with the PCB and a light guiding element for displaying a sound volume. One end of the touch element is disposed to protrude from the housing, and the other end of the touch element faces towards the silicone button, the button circuit board and the flexible circuit board. The touch pressing plate comprises receiving cavities for receiving the silicone button, the button circuit board and the flexible circuit board. The touch pressing plate is fixedly connected with the housing and clamps the touch element; and the light guiding element comprises a plurality of light sources distributed uniformly along a same circumference, and all of the light sources are connected with the PCB.

Preferably, the sound box further comprises a partition for preventing formation of an eddy at the center of the fan blade. The partition is located at one side of the fan blade that faces away from the housing, and is fixedly connected with the transparent base.

Preferably, the audio playing device further comprises an auxiliary sound box electrically connected with the sound box.

For the sound box of the present disclosure, the fixing plate is rotated by the motor and, under the magnetic force generated between the first magnets and the second magnets, the fan blade rotates together with the rotary shaft of the motor. Then, a liquid in the first water tank is drained off by the fan blade to the second water tank, and next the liquid in the second water tank is sprayed out from the spray nozzle owing to the pressure to form water columns of a corresponding height. The liquid sprayed out then flows back into the first water tank due to the gravity, thus achieving recycling of the liquid. Because the motor controls the fan blade to rotate by means of the magnetic force generated between the first magnets and the second magnets, an enclosed space is formed between the transparent base and the transparent cover to isolate the motor from water, and thus the service life of the motor is effectively extended.

Implementations for achieving the objectives of the present disclosure as well as features and advantages thereof will be further described hereinbelow with reference to embodiments thereof and the accompanying drawings.

DETAILED DESCRIPTION OF THE INVENTION

It shall be understood that, the embodiments described herein are only provided for purpose of illustration rather than to limit the present disclosure.

The present disclosure provides a sound box.

Figure 1:
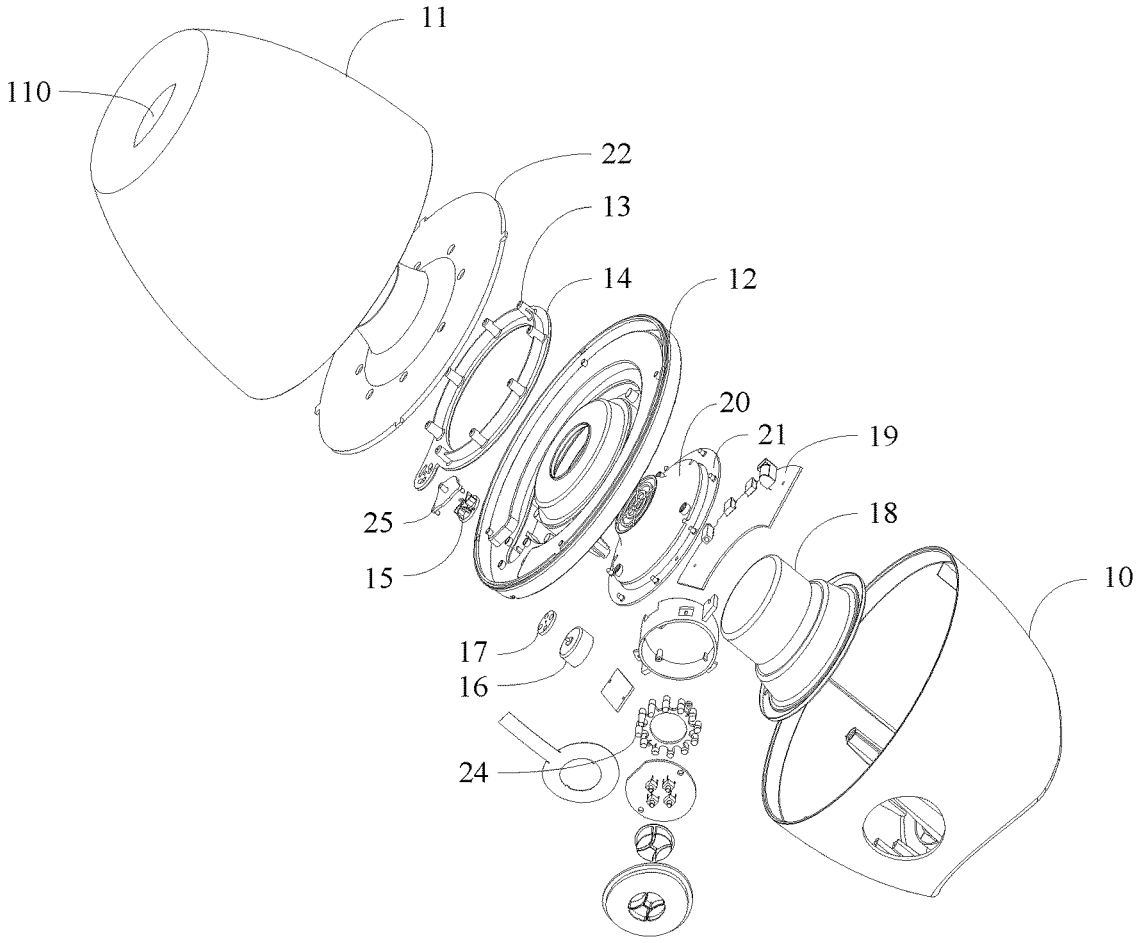
FIG. 1 is a schematic exploded structural view of a sound box according to an embodiment of the present disclosure.
Figure 2:
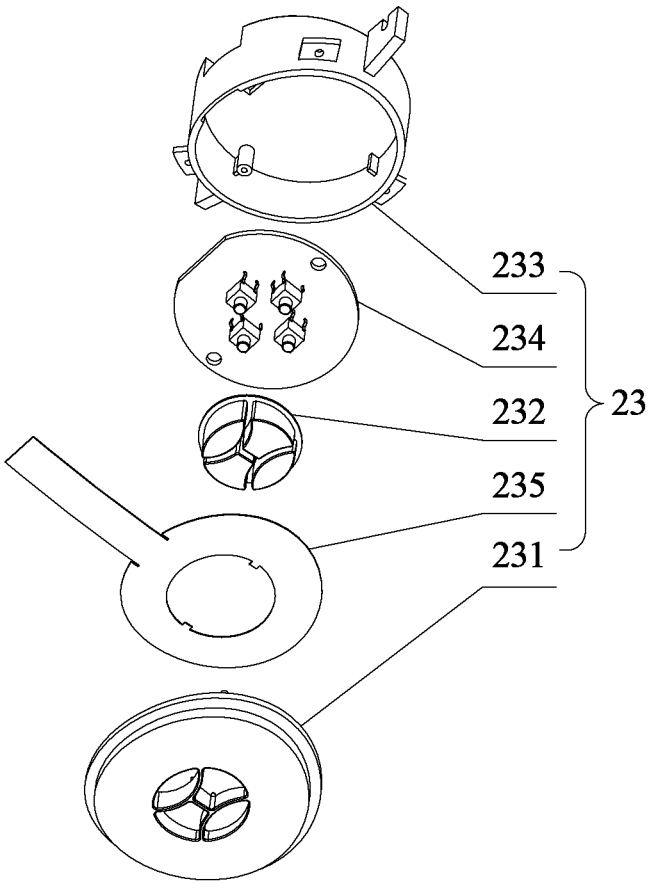
FIG. 2 is a schematic structural view of the button controlling unit in FIG. 1.
Figure 3:
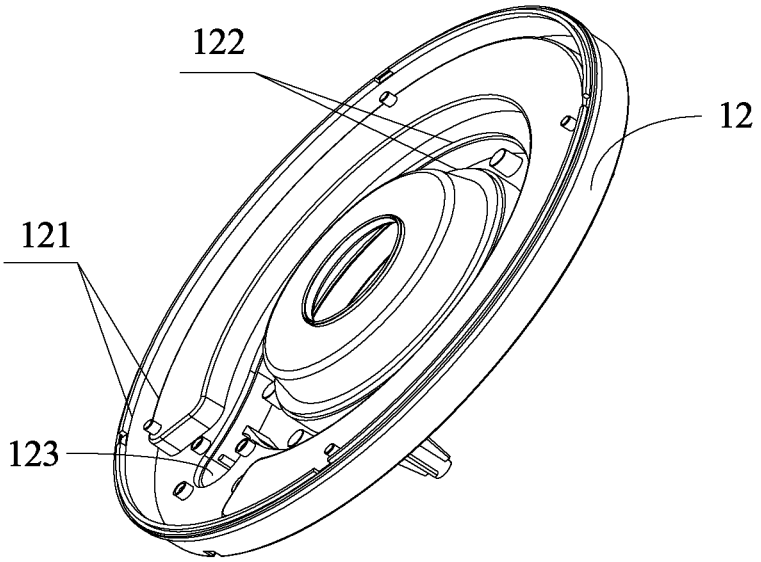
FIG. 3 is a schematic structural view of the transparent base in FIG. 1.

Referring to FIG. 1 to FIG. 3, FIG. 1 is a schematic exploded structural view of a sound box according to an embodiment of the present disclosure; FIG. 2 is a schematic structural view of the button controlling unit in FIG. 1; and FIG. 3 is a schematic structural view of the transparent base in FIG. 1. The sound box provided in this embodiment comprises a housing 10, a transparent cover 11 fixedly connected with the housing 10, a transparent base 12 fixedly connected with the transparent cover 11, a water spraying plate 14 provided with a spray nozzle 13 and a fan blade 15 for draining off water. A first water tank 121, a second water tank 122 and a receiving tank 123 for receiving the fan blade are provided on the transparent base 12. The receiving tank 123 communicates with the first water tank 121 and the second water tank 122 respectively and a liquid in the first water tank 121 is drained off by the fan blade 15 to the second water tank 122. The water spraying plate 14 is adapted to the second water tank 122 and the fan blade 15 is provided with first magnets (not shown). The housing 10 has a motor 16 and a fixing plate 17 disposed therein. A rotary shaft of the motor 16 is fixedly connected with the fixing plate 17 and the fixing plate 17 is provided with second magnets to cooperate with the first magnets.

In this embodiment, the aforesaid transparent cover 11 has a water spraying space disposed therein for the spray nozzle 13 to spray water. The number of the aforesaid second magnets may be determined depending on the actual need. In this embodiment, there are preferably four second magnets distributed uniformly on the fixing plate 17 along a same circumference about the rotating center thereof. The first magnets are disposed corresponding to the second magnets to produce a mutual repulsion or mutual attraction force therebetween. Both the first water tank 121 and the second water tank 122 are used for storing the liquid.

For the sound box of the present disclosure, the fixing plate 17 is rotated by the motor 16 and, under the magnetic force generated between the first magnets and the second magnets, the fan blade 15 rotates together with the rotary shaft of the motor 16. Then, the liquid in the first water tank 121 is drained off by the fan blade 15 to the second water tank 122, and next the liquid in the second water tank 122 is sprayed out from the spray nozzle 13 due to the pressure. The liquid sprayed out then flows back into the first water tank 121 due to the gravity, thus achieving the purpose of recycling the liquid. By means of the magnetic force generated between the first magnets and the second magnets, the fan blade 15 rotates, under the control of the motor 16, in an enclosed space formed between the transparent base 12 and the transparent cover 11 to isolate the motor 16 from the liquid. Therefore, the service life of the motor 16 is effectively extended.

Specifically, the locations of the receiving tank 123 and the first water tank 121 may be determined depending on the actual need. In this embodiment, in order to increase the water pressure in the receiving tank 123, the receiving tank 123 is preferably located at a lowest water storage position of the first water tank 122. The first water tank and the second water tank are disposed in the form of an outer ring and an inner ring respectively, with the first water tank 121 being the outer ring and the second water tank 122 being the inner ring. The receiving tank 123 is disposed between the inner ring and the outer ring and is formed to be recessed from the lowest water storage position.

It should be appreciated that, the first magnets and the second magnets are disposed to face towards each other. If the first magnets disposed on the fan blade 15 and the second magnets disposed on the fixing plate 17 do not exactly face towards each other, the magnetic force therebetween might become disordered, which would be unfavorable for the rotation of the fan blade 15.

Furthermore, on the basis of the aforesaid embodiment, the aforesaid sound box in this embodiment further comprises a loudspeaker 18 and a PCB 19 which are located in the housing 10 and fixedly connected with the housing 10. The PCB 19 is electrically connected with the loudspeaker 18 and the motor 16 respectively to output an external sound source signal to the loudspeaker 18 and, according to an audio level of the external sound source signal, output a control signal to the motor 16 to control the rotation speed of the motor 16.

In this embodiment, as the rotation speed of the motor 16 increases, the rotation speed of the fan blade 15 also increases, and therefore the hydraulic pressure in the second water tank 122 increases to result in a higher liquid column sprayed out from the spraying nozzle 13. Because the rotation speed of the motor is controlled according to the audio signal level of the external sound source signal, a higher audio signal level of the external sound source signal results in a higher liquid column sprayed out in the transparent cover 11. That is, the height of the liquid column varies with the audio signal level, so it becomes more enjoyable to watch.

Further on the basis of the aforesaid embodiment, in this embodiment, the transparent cover 11 is formed with a sound transmission channel 110 extending through a top portion and a bottom portion thereof; a sound guiding element 20 for guiding the sound from the loudspeaker 18 to the sound transmission channel 110 is disposed in the housing 10 and fixedly connected with the transparent base 12.

In this embodiment, the sound guiding element 20 is disposed to be horn-shaped, and a smaller end thereof is formed with a plurality of holes that are arranged in a mesh pattern and disposed to face towards the sound transmission channel 110 of the transparent cover 11. By disposing the sound guiding element 20, the acoustic quality of the sound played by the sound box can be effectively improved. In addition, entry of foreign materials into the housing 10 through the sound transmission channel 110 to cause damage of elements in the housing 10 can be effectively prevented. By disposing the sound transmission channel 110 in this way, the sound generated by the loudspeaker 18 can be transmitted out from the top of the sound box with much better sound transmission quality than the conventional practice where the loudspeaker 18 is disposed on a side surface of the housing 10, and the sounding direction of the sound box is no longer constrained by the opening direction of the loudspeaker 18 (in the conventional practice, the loudspeaker 18 is disposed on a side surface of the housing 10 and the sounding direction is constrained by the opening direction of the loudspeaker), thus providing better listening experiences for the user.

In this embodiment, the aforesaid sound box further comprises a lamp holder 21 installed with an LED lamp 21 and a light shielding plate 22 for shielding light. The lamp holder 21 is fixedly connected with the transparent base 12 and cooperates with the transparent base 12 to clamp the sound guiding element 20. The LED lamp is disposed to face towards the spray nozzle 13, and the light shielding plate 22 is formed with a through-hole that is adapted to the spray nozzle 13.

In this embodiment, by disposing the LED lamp under the transparent base 12 and by using the light shielding plate 22 to shield the light emitted by the LED lamp, the light can only pass through the spray nozzle 13 to propagate into the transparent cover. Thus, a lighting effect is achieved for the liquid sprayed from the second water tank 122 by the spray nozzle 13, which provides a better visual effect and makes the sound box more suitable for use.

On the basis of the aforesaid embodiment, the sound box in this embodiment further comprises a button controlling unit 23 for controlling an operation state of the sound box. The button controlling unit 23 comprises a touch element 231, a silicone button 232, a touch pressing plate 233, a button circuit board 234 electrically connected with the PCB 19 and a flexible circuit board 235 electrically connected with the PCB 19. One end of the touch element 231 is disposed to protrude from the housing 10, and the other end of the touch element 231 faces towards the silicone button 232, the button circuit board 234 and the flexible circuit board 235. The touch pressing plate 233 comprises receiving cavities for receiving the silicone button 232, the button circuit board 234 and the flexible circuit board 235. The touch pressing plate 233 is fixedly connected with the housing 10 and clamps the touch element 231.

In this embodiment, the flexible circuit board 235 is disposed to be ring-shaped and is nested onto the silicone button 232. Both the flexible circuit board 235 and the silicone button 232 touch the touch element 231, and when the touch element 231 is pressed at a corresponding position, the flexible circuit board 235 or the silicone button 232 will be triggered. Specifically, the flexible circuit board is formed with contacts for adjusting the sound volume, and the silicone button 232 comprises a mega bass tuning switch, a power supply controlling switch, etc.

Furthermore, on the basis of the aforesaid embodiment, the sound box in this embodiment further comprises a light guiding element 24 for displaying a sound volume. The light guiding element 24 comprises a plurality of light sources distributed uniformly along a same circumference, and all of the light sources are connected with the PCB 24.

In this embodiment, the light sources may be LED lamps. When the sound volume is at its maximum value, the light sources on the light guiding element 24 are all lighted up; and when the sound volume is gradually reduced, the PCB 19 will transmit a control signal to the light guiding element 24 so that the light sources are controlled to be lighted off sequentially in the counterclockwise direction. Because the sound guiding element is disposed to display the current sound volume, the current sound volume can be displayed in a more intuitive manner and this makes it convenient for the user to adjust the sound volume.

Furthermore, the sound box further comprises a partition 25 for preventing formation of an eddy at the center of the fan blade 15. The partition 25 is located at one side of the fan blade 15 that faces away from the housing 10, and is fixedly connected with the transparent base 12.

In this embodiment, the partition 25 is located right above the fan blade 15. By disposing the partition 25, the liquid in the first water tank 121 can flow into the receiving tank 123 from the edge of the partition 25, thus preventing formation of an eddy right above the fan blade 15 due to the high rotation speed thereof. Therefore, by disposing the partition 25, the liquid columns formed by the liquid sprayed out from the spray nozzle 13 become higher.

The present disclosure further provides an audio playing device that comprises a sound box. The structure of the sound box is just as described above in the aforesaid embodiments, so it will not be described again. Of course, because the technical solution of the aforesaid sound box is adopted in the audio playing device of this embodiment, the audio playing device has all the benefits of the aforesaid sound box.

Furthermore, on the basis of the aforesaid embodiment, the audio playing device in this embodiment further comprises an auxiliary sound box electrically connected with the sound box. The auxiliary sound box may comprise a first auxiliary sound box for playing the left channel sound and a second auxiliary sound box for playing the right channel sound. The PCB of the aforesaid sound box is electrically connected with a motor in the auxiliary sound box and, according to an audio level of an external sound source signal, outputs a control signal to the motor of the auxiliary sound box so as to control the rotation speed of the motor in the auxiliary sound box. By additionally providing the two auxiliary sound boxes to play the left channel sound and the right channel sound respectively, the sound playing effect is improved.

What described above are only the embodiments of the present disclosure, but are not intended to limit the scope of the present disclosure. Any equivalent structures or equivalent process flow modifications that are made according to the specification and the attached drawings of the present disclosure, or any direct or indirect applications of the present disclosure in other related technical fields shall all be covered within the scope of the present disclosure.

What is claimed is:

1. A sound box, comprising a housing and a transparent cover fixedly connected with the housing, wherein the sound box further comprises a transparent base fixedly connected with the transparent cover, a water spraying plate provided with a spray nozzle, and a fan blade for draining off water, a first water tank, a second water tank and a receiving tank for receiving the fan blade are provided on the transparent base, the receiving tank communicates with the first water tank and the second water tank respectively and a liquid in the first water tank is drained off by the fan blade to the second water tank; the water spraying plate is adapted to the second water tank; the fan blade is provided with first magnets; the housing has a motor, a fixing plate and a loudspeaker disposed therein, the loudspeaker and a rotary shaft of the motor are fixedly connected with the fixing plate respectively, the fixing plate is provided with second magnets to cooperate with the first magnets, the transparent cover is further formed with a sound transmission channel extending through a top portion and a bottom portion thereof; and a sound guiding element for guiding the sound from the loudspeaker to the sound transmission channel is disposed in the housing and fixedly connected with the transparent base.

2. The sound box of claim 1, wherein the receiving tank is located at a lowest water storage position of the first water tank and is formed to be recessed from the lowest water storage position.

3. The sound box of claim 1, further comprising a printed circuit board (PCB) located in the housing and fixedly connected with the housing, wherein the PCB is electrically connected with the loudspeaker and the motor respectively to output an external sound source signal to the loudspeaker and, according to an audio level of the external sound source signal, output a control signal to the motor to control the rotation speed of the motor.

4. The sound box of claim 1, further comprising a partition for preventing formation of an eddy at the center of the fan blade, wherein the partition is located at one side of the fan blade that faces away from the housing, and is fixedly connected with the transparent base.

5. The sound box of claim 2, wherein the first magnets and the second magnets are disposed to face towards each other.

6. The sound box of claim 3, further comprising a lamp holder installed with an LED (light emitting diode) lamp and a light shielding plate for shielding light, wherein the lamp holder is fixedly connected with the transparent base and cooperates with the transparent base to clamp the sound guiding element, the LED lamp is disposed to face towards the spray nozzle, and the light shielding plate is formed with a through-hole that is adapted to the spray nozzle.

7. The sound box of claim 6, further comprising a button controlling unit for controlling an operation state of the sound box, wherein the button controlling unit comprises a touch element, a silicone button, a touch pressing plate, a button circuit board electrically connected with the PCB, a flexible circuit board electrically connected with the PCB and a light guiding element for displaying a sound volume; one end of the touch element is disposed to protrude from the housing, and the other end of the touch element faces towards the silicone button, the button circuit board and the flexible circuit board; the touch pressing plate comprises receiving cavities for receiving the silicone button, the button circuit board and the flexible circuit board, the touch pressing plate is fixedly connected with the housing and clamps the touch element; and the light guiding element comprises a plurality of light sources distributed uniformly along a same circumference, and all of the light sources are connected with the PCB.

8. An audio playing device, comprising a sound box, wherein the sound box comprises a housing, a transparent cover fixedly connected with the housing, a transparent base fixedly connected with the transparent cover, a water spraying plate provided with a spray nozzle and a fan blade for draining off water, a first water tank, a second water tank and a receiving tank for receiving the fan blade are provided on the transparent base, the receiving tank communicates with the first water tank and the second water tank respectively and a liquid in the first water tank is drained off by the fan blade to the second water tank; the water spraying plate is adapted to the second water tank; the fan blade is provided with first magnets; the housing has a motor, a fixing plate and a loudspeaker disposed therein, the loudspeaker and a rotary shaft of the motor are fixedly connected with the fixing plate respectively, the fixing plate is provided with second magnets to cooperate with the first magnets, the transparent cover is further formed with a sound transmission channel extending through a top portion and a bottom portion thereof; and a sound guiding element for guiding the sound from the loudspeaker to the sound transmission channel is disposed in the housing and fixedly connected with the transparent base.

9. The audio playing device of claim 8, wherein the receiving tank is located at a lowest water storage position of the first water tank and is formed to be recessed from the lowest water storage position.

10. The audio playing device of claim 8, wherein the sound box further comprises a printed circuit board (PCB) located in the housing and fixedly connected with the housing, wherein the PCB is electrically connected with the loudspeaker and the motor respectively to output an external sound source signal to the loudspeaker and, according to an audio level of the external sound source signal, output a control signal to the motor to control the rotation speed of the motor.

11. The audio playing device of claim 8, wherein the sound box further comprises a partition for preventing formation of an eddy at the center of the fan blade, wherein the partition is located at one side of the fan blade that faces away from the housing, and is fixedly connected with the transparent base.

12. The audio playing device of claim 8, further comprising an auxiliary sound box electrically connected with the sound box.

13. The audio playing device of claim 9, wherein the first magnets and the second magnets are disposed to face towards each other.

14. The audio playing device of claim 10, wherein the sound box further comprises a lamp holder installed with an LED (light emitting diode) lamp and a light shielding plate for shielding light, wherein the lamp holder is fixedly connected with the transparent base and cooperates with the transparent base to clamp the sound guiding element, the LED lamp is disposed to face towards the spray nozzle, and the light shielding plate is formed with a through-hole that is adapted to the spray nozzle.

15. The audio playing device of claim 10, wherein the sound box further comprises a button controlling unit for controlling an operation state of the sound box, wherein the button controlling unit comprises a touch element, a silicone button, a touch pressing plate, a button circuit board electrically connected with the PCB, a flexible circuit board electrically connected with the PCB and a light guiding element for displaying a sound volume; one end of the touch element is disposed to protrude from the housing, and the other end of the touch element faces towards the silicone button, the button circuit board and the flexible circuit board; the touch pressing plate comprises receiving cavities for receiving the silicone button, the button circuit board and the flexible circuit board, the touch pressing plate is fixedly connected with the housing and clamps the touch element; and the light guiding element comprises a plurality of light sources distributed uniformly along a same circumference, and all of the light sources are connected with the PCB.

* * * * *